US008661756B2

(12) United States Patent
Boyer et al.

(10) Patent No.: US 8,661,756 B2
(45) Date of Patent: Mar. 4, 2014

(54) INSULATED METAL VERTICAL JOINT INSERT

(75) Inventors: Keith D. Boyer, Moon Township, PA (US); Larry A. Wesche, Moon Township, PA (US); Dario Giandomenico, Mt. Lebanon, PA (US); Richard A. Brow, Venetia, PA (US)

(73) Assignee: Centria, Moon Township, PA (US)

( * ) Notice: Subject to any disclaimer, the term of this patent is extended or adjusted under 35 U.S.C. 154(b) by 53 days.

(21) Appl. No.: 13/043,857

(22) Filed: Mar. 9, 2011

(65) Prior Publication Data

US 2011/0252737 A1 Oct. 20, 2011

Related U.S. Application Data

(60) Provisional application No. 61/326,059, filed on Apr. 20, 2010.

(51) Int. Cl.
*E04C 3/00* (2006.01)

(52) U.S. Cl.
USPC ..... 52/459; 52/461; 52/782.1

(58) Field of Classification Search
USPC ..... 52/459, 461, 782.1, 302.4
See application file for complete search history.

(56) References Cited

U.S. PATENT DOCUMENTS

| | | | | |
|---|---|---|---|---|
| 5,048,248 | A * | 9/1991 | Ting | 52/309.9 |
| 5,445,861 | A * | 8/1995 | Newton et al. | 428/116 |
| 5,544,461 | A | 8/1996 | Sommerstein | |
| 5,749,282 | A | 5/1998 | Brow et al. | |
| 6,253,511 | B1 | 7/2001 | Boyer | |
| 6,421,974 | B1 | 7/2002 | Whitehouse et al. | |
| 6,484,465 | B2 | 11/2002 | Higgins | |
| 6,694,694 | B2 | 2/2004 | Zeeff | |
| 7,752,818 | B1 * | 7/2010 | Roegge et al. | 52/235 |
| 8,166,716 | B2 * | 5/2012 | Macdonald et al. | 52/235 |
| 2007/0119105 | A1 * | 5/2007 | MacDonald et al. | 52/235 |

* cited by examiner

*Primary Examiner* — Jeanette E Chapman
*Assistant Examiner* — Daniel Kenny
(74) *Attorney, Agent, or Firm* — The Webb Law Firm

(57) ABSTRACT

A composite panel assembly includes first and second panels. An edge of the first panel is positioned adjacent to an edge of the second panel to define a joint. The edge of the first panel and the edge of the second panel each define a recessed portion. An insert is positioned between the first and second panels at the joint. A portion of the insert is received within respective recessed portions of the first and second panels.

9 Claims, 9 Drawing Sheets

INSULATED METAL VERTICAL JOINT INSERT

CROSS REFERENCE TO RELATED APPLICATIONS

This application claims the benefit of U.S. Provisional Application No. 61/326,059, filed Apr. 20, 2010, the entire content of which is hereby incorporated by reference.

BACKGROUND OF THE INVENTION

1. Field of the Invention

The present invention is directed toward composite wall panels and, more particularly, towards a joint insert for a vertical end joint between adjacent composite panels.

2. Description of Related Art

Composite wall panels typically include one or more metal facers that encase a homogenous core, such as an insulated foam core. A number of composite wall panels may be attached to spaced vertical supports secured to exterior building frames in a horizontal orientation. A wall surface is formed by the wall panels joined together along their sides to form horizontal joints and along their ends to form vertical joints. Each of the panels is also typically provided with one or more "male" or "female" connecting portions, each configured to accommodate respective "female" or "male" connecting portions of the other panel. The building panels need to be sealed properly to prevent leaks in the exterior wall structure formed by the building panels. Typically, the seals at the vertical end joints of the building panels have been achieved using a sealant, such as a non-curing butyl, to provide a sealant bead between the inner metal facer and a gage metal seal plate. Further, a gasket, such as a neoprene rubber gasket, is positioned within the vertical end after the panels are erected. Depending on the quality of the installation, the gasket may become loose. Also, if the vertical end joint was too tight, the gasket may not be inserted at the proper depth. If the vertical end joint was too wide, the gasket may not engage the panel edges.

U.S. Pat. No. 6,253,511 to Boyer and U.S. Pat. No. 5,749,282 to Brow et al. disclose composite panels and are hereby incorporated by reference in their entirety.

SUMMARY OF THE INVENTION

In one embodiment, a composite panel assembly includes first and second panels. An edge of the first panel is positioned adjacent to an edge of the second panel to define a joint. The edge of the first panel and the edge of the second panel each define a recessed portion. An insert is positioned between the first and second panels at the joint. A portion of the insert is received within respective recessed portions of the first and second panels.

The first and second panels may include a reveal at the joint, where the reveal is defined by the first and second panels and the insert. The insert may comprise a foam body. The first and second panels may each include an inner surface and an outer surface with the recessed portions of the first panel and the second panel extending from the respective inner surfaces to a position intermediate the respective inner surfaces and the respective outer surfaces. The insert may comprise a body and a facer. The facer of the insert may engage the first and second panels and the body may have a pair of front chamfered portions to define drain cavities. The body may also have a pair of rear chamfered portions to define sealant receiving spaces. The first and second panels may each include an outer face, an inner liner, and a core positioned between the inner liner and the outer face. The insert may comprise a body that is generally trapezoid-shaped with the recessed portions of the first and second panels correspondingly shaped to receive the body. The first and second panels may each include an inner surface and an outer surface with the recessed portions being positioned intermediate the inner surface and the outer surface. The insert may comprise a body that is generally plate-shaped. The insert may also comprise a body and a facer with a portion of the facer positioned within the recessed portions of the first and second panels and the body of the insert positioned between the first and second panels.

In a further embodiment, a composite panel assembly includes first and second panels. The first and second panels have an inner surface and an outer surface. An edge of the first panel is positioned adjacent to an edge of the second panel to define a joint. The edge of the first panel and the edge of the second panel each define a recessed portion positioned intermediate the inner surface and the outer surface. The composite panel assembly further includes a pair of panel clips configured to secure the respective first and second panels to a support. Each of the pair of panel clips defines a notch that receives a portion of the respective recessed portions. An insert is positioned between the first and second panels at the joint. A portion of the insert is received within respective recessed portions of the first and second panels. The first and second panels may each include an extended portion at the joint to form a reveal.

In another embodiment, a panel includes a first edge, a second edge, a third edge and a fourth edge. The first edge is positioned opposite the third edge and the second edge is positioned opposite the fourth edge. The first and second edges each have an extension. The third and fourth edges each define a pocket. The extensions are configured to be received within a corresponding pocket of an adjacent panel and the pockets are configured to receive a corresponding extension of an adjacent panel. The extensions are configured to be slidable relative to the pockets during installation to adjust a reveal between adjacent panels.

The panel may comprise an outer face, an inner liner, and a core positioned between the inner liner and the outer face. The extension of the second edge may comprise a portion of the outer face and the first edge may include first and second extensions. The first extension of the first edge may comprise a portion of the outer face and the second extension of the first edge may comprise a portion of the inner face.

In yet another embodiment, a panel assembly includes first and second panels. An edge of the first panel is positioned adjacent to an edge of the second panel to define a joint. The edge of the first panel has an extension and the edge of the second panel defines a pocket. The extension of the first panel is received by the pocket of the second panel. The extension of the first panel is spaced from an outer surface of the first panel and the extension is configured to be slidable relative to the pocket during installation to adjust a reveal between the first and second panels.

The first and second panels each comprise an outer face, an inner liner, and a core positioned between the inner liner and the outer face. The extension of the first panel may comprise a portion of the outer face of the first panel, and the pocket of the second panel may comprise a portion of the outer face of the second panel.

DESCRIPTION OF THE PREFERRED EMBODIMENTS

Figure 1:
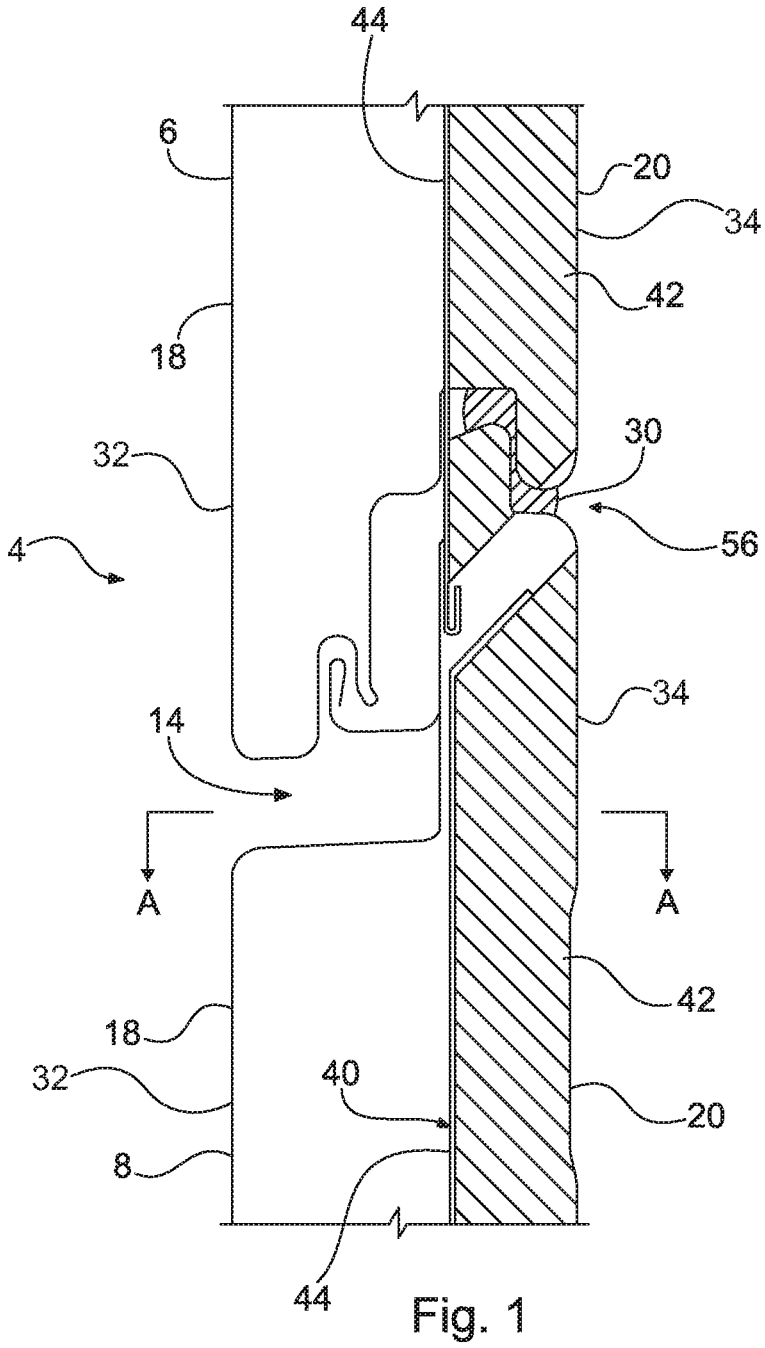
FIG. 1 is a partial cross-sectional view of a composite panel assembly according to a first embodiment of the present invention.

The present invention will now be described with reference to the accompanying figures. For purposes of the description hereinafter, the terms "upper", "lower", "right", "left", "vertical", "horizontal", "top", "bottom" and derivatives thereof shall relate to the invention as it is oriented in the drawing figures. However, it is to be understood that the invention may assume various alternative variations and step sequences, except where expressly specified to the contrary. It is to be understood that the specific apparatus illustrated in the attached figures and described in the following specification is simply an exemplary embodiment of the present invention. Hence, specific dimensions and other physical characteristics related to the embodiments disclosed herein are not to be considered as limiting.

Figure 2:
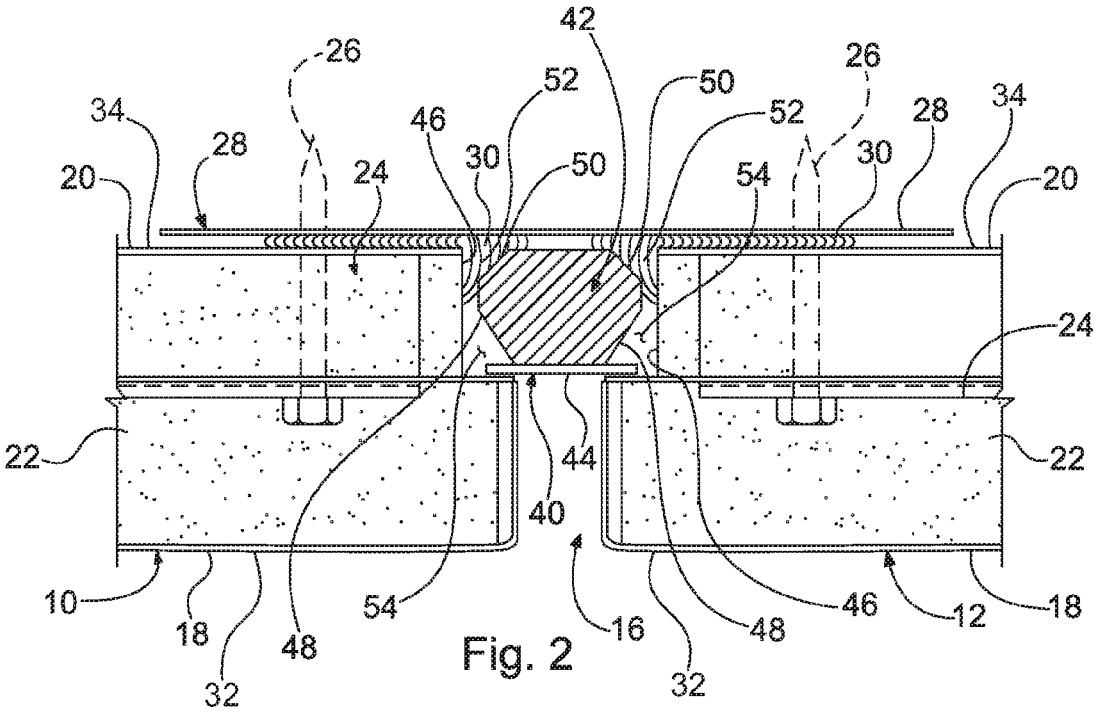
FIG. 2 is a partial cross-sectional view of the composite panel assembly of FIG. 1 taken along the line A-A.

Referring to FIGS. 1 and 2, a composite panel assembly 4 according to a first embodiment includes upper and lower building panels 6, 8 positioned adjacent to each other to define a horizontal joint 14 (shown in FIG. 1) and right and left building panels 10, 12 positioned adjacent to each other to define a vertical joint 16 (shown in FIG. 2). Each of the panels 6, 8, 10, 12 includes an outer face 18 and inner liner 20 with a core 22 positioned therebetween. The outer face 18 and inner liner 20 may be metal and the core 22 may be an insulated foam material, although other suitable materials may be used for the face 18, liner 20, and core 22. Each of the panels 6, 8, 10, 12 also includes a panel clip 24 and fastener 26 at the horizontal joint 14. The fasteners 26 secure the panels 6, 8, 10, 12 to a structural member (not shown), such as a stud. Flashing 28 is positioned between the inner liner 20 and the structural member with sealant 30, such as a non-curing butyl sealant, provided between the inner liner 20 and the flashing 28 to seal the panels 6, 8, 10, 12 at the vertical joint 16. The panels 6, 8, 10, 12 each include an inner surface 32 and an outer surface 34.

A joint insert 40 is positioned within the vertical joint 16 and includes a body 42 and a facer 44. As shown in FIG. 2, each of the panels 10, 12 defines a recessed portion 46 at the vertical joint 16 for receiving and engaging the joint insert 40 thereby holding the insert 40 in place. In one non-limiting embodiment, the material removed from each panel 10, 12 to define the respective recessed portions 46 has a width of ½", although other suitable widths may be utilized. The formation of the recessed portions 46 may be performed in line. The facer 44 is an elongate strip of material that is secured to the body 42, although other suitable shapes may be utilized for the facer 44. For instance, the facer 44 may formed to increase the stiffness of the facer 44 by including ribs, curved edges, or any other suitable arrangement for increasing stiffness. The joint insert 40 may also include an additional piece of material secured to the body 42 and positioned opposite the facer 44 as discussed below, for example, in connection with the embodiment shown in FIG. 3. The recessed portions 46 of the panels 10, 12 extend from the respective inner surfaces 32 to a position intermediate the respective inner surface 32 and the respective outer surfaces 34. The facer 44 may be adhered to the body 42 using an adhesive, although other suitable arrangements for securing the facer 44 to the body 42 may be utilized. The facer 44 may be metal, such as the same metal used for the outer face 18, although other suitable materials may be used for the facer 44. The facer 44 may be more readily colored relative to conventional rubber gaskets. The body 42 is an elongate member having front chamfered portions 48 and rear chamfered portions 50. In particular, the body 42 may be an insulating foam block having its corners routed to define the front and rear chamfered portions 48, 50, although the body 42 may be formed from any other suitable insulating material.

Referring to FIG. 2, the rear chamfered portions 50 of the body 42 define sealant receiving spaces 52. The sealant receiving spaces 52 are generally defined by the flashing 28, the rear chamfer portions 50 of the body 42, and the panels 10, 12. The sealant receiving spaces 52 allow sealant 30 to flow and fill the receiving spaces 52 during installation of the panels 10, 12. The front chamfered portions 48 of the body 42 define drain cavities 54. The drain cavities 54 allow water to drain behind the facer 44 and are generally defined by the panels 10, 12, the front chamfered portions 48 of the body 42 and the facer 44. The joint insert 40 generally has a length equal to the vertical width of the panels 10, 12, i.e., the length of the vertical joint 16 between adjacent panels. A splice 56 in the joint insert 40 may be provided at a position adjacent to the horizontal joint 14 such that repairs may be made to the seals of the panels 10, 12 without removing the panels 10, 12 or the insert 40.

The joint insert 40 is installed as the panels 6, 8, 10, 12 are being assembled. In particular, the joint insert 40 is positioned within the vertical joint 16 and the fasteners 26 are installed such that the joint insert 40 is clamped in place by the panels 6, 8, 10, 12. As shown in FIG. 2, the panels 10, 12 engage the facer 44 at a position adjacent to the recessed portions 46. The receiving and engagement of the insert 40 by the panels 10, 12 ensures the insert 40 remains in place after installation. The joint insert 40 insulates the vertical joint 16 substantially better than conventional rubber gaskets. More specifically, conventional rubber gaskets typically have trapped air and results in an R1 insulation value for the vertical joint. The joint insert 40, which in one non-limiting embodiment is ¾" thick, can achieve an R5 insulation value for the joint width. Increasing the thickness of the panels 10, 12 allows for a thicker joint insert 40 (in a direction that extends from the outer surface 34 to the inner surface 32) such that the insulation value for the joint width can be increased whereas increasing the thickness of conventional rubber gaskets does not yield similar increases in insulation value at the joint width. As shown in FIG. 2, the space on either side of the joint insert 40 allows the distance between the panels 10, 12 to be adjusted during installation. The receiving and engaging of the joint insert 40 by the panels 10, 12 enables the width of the vertical joint 16 to have a larger tolerance while conventional rubber gaskets would not seat properly if the width of the vertical joint was too narrow or wide. In other words, the secure fitting of the joint insert 40 within the vertical joint 16 is not entirely dependent on the width of the vertical joint 16.

Figure 3:
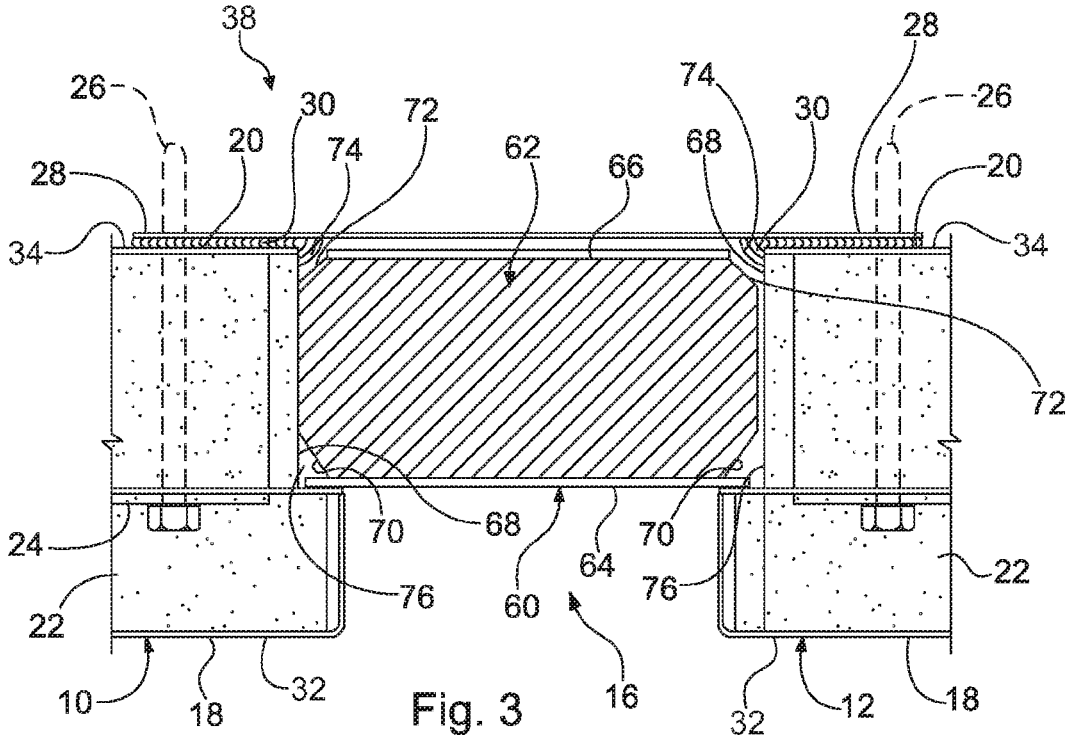
FIG. 3 is a partial cross-sectional view of a composite panel assembly according to a second embodiment of the present invention.

Referring to FIG. 3, a second embodiment of composite panel assembly 38 having a joint insert 60 is disclosed. The panel assembly 38 is similar to the composite panel assembly 4 described above and shown in FIGS. 1 and 2. Like reference numerals are used for like parts. The joint insert 60 includes a body 62 with a facer 64 and a liner 66. The facer 64 is positioned opposite the liner 66 with the body 62 positioned therebetween. The joint insert 60 of the present embodiment is received and engaged by a recessed portion 68 defined by each of the panels 10, 12 at the vertical joint 16 thereby holding the insert 60 in place. The facer 64 and the liner 66 are elongate strips of material that are secured to the body 62, although other suitable shapes may be utilized for the facer 64 and liner 66. For instance, the facer 64 and liner 66 may formed to increase the stiffness of the facer 64 and liner 66 by including ribs, curved edges, or any other suitable arrangement for increasing stiffness. The facer 64 and the liner 66 may be adhered to the body 62 using an adhesive, although other suitable arrangements for securing the facer 64 and the liner 66 to the body 62 may be utilized. The facer 64 and liner 66 may be metal, such as the same metal used for the outer face 18 and inner liner 20, although other suitable materials may be used. The body 62 is an elongate member having front chamfered portions 70 and rear chamfered portions 72. The body 62 may be an insulating foam block having its corners routed to define the front and rear chamfered portions 70, 72, although the body 62 may be formed from any other suitable insulating material.

The rear chamfered portions 72 of the body 62 define sealant receiving spaces 74. The sealant receiving spaces 74 are generally defined by the flashing 28, the rear chamfer portions 72 of the body 62, and the panels 10, 12. The sealant receiving spaces 74 allow sealant 30 to flow and fill the receiving spaces 74 during installation of the panels 10, 12. The front chamfered portions 70 of the body 62 define drain cavities 76. The drain cavities 76 allow water to drain behind the facer 64 and are generally defined by the panels 10, 12, the front chamfered portions 70 of the body 62 and the facer 64. The joint insert 60 may be installed in a similar manner as described above with respect to joint insert 40. The joint insert 60 may be utilized for wide reveals at the vertical joint 16. In particular, the joint insert 60 may be used for a reveal having a width of about 2 to 6 inches.

Figure 4:
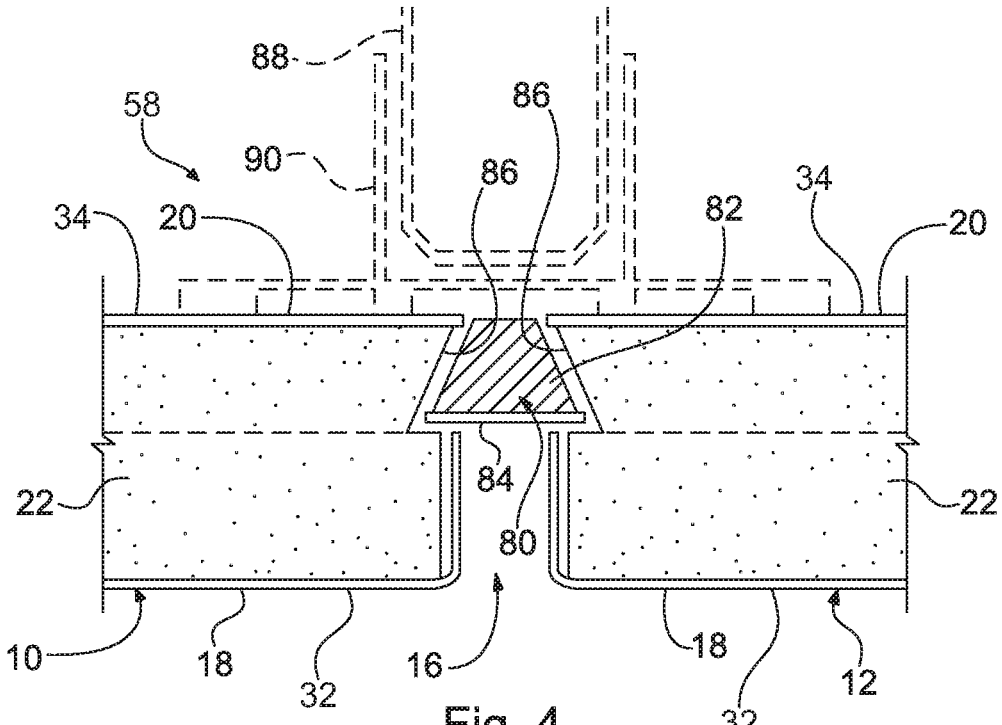
FIG. 4 is a partial cross-sectional view of a composite panel assembly according to a third embodiment of the present invention.

Referring to FIG. 4, a third embodiment of a composite panel assembly 58 having a joint insert 80 is disclosed. The composite panel assembly 58 is similar to the composite panel assembly 4 described above and shown in FIGS. 1 and 2. Like reference numerals are used for like elements. The joint insert 80 includes a body 82 and a facer 84. The joint insert 80 of the present embodiment is received and engaged by a recessed portion 86 defined by each of the panels 10, 12 at the vertical joint 16 thereby holding the insert 80 in place. More specifically, the recessed portion 86 is defined by beveled rabbet cuts in each of the panels 10, 12 at the vertical joint 16 to form the generally trapezoid-shaped recessed portion 86.

The recessed portion 86 may leave the inner liners 20 of the panels 10, 12 intact. The facer 84 is an elongate strip of material that is secured to the body 82, although other suitable shapes may be utilized for the facer 84. For instance, the facer 84 may formed to increase the stiffness of the facer 84 by including ribs, curved edges, or any other suitable arrangement for increasing stiffness. The facer 84 may be adhered to the body 82 using an adhesive, although other suitable arrangements for securing the facer to the body 82 may be utilized. The facer 84 may be metal, such as the same metal used for the outer face 18, although other suitable materials may be used for the facer 84. The body 82 is an elongate member that is generally trapezoid-shaped in cross-section and is configured to be received by the recessed portion 86. In a particular non-limiting embodiment, the body 82 is about 1⅜" wide and ¾" deep. The body 82 may be an insulating foam block, although the body 82 may be formed from any other suitable insulating material. Further, as shown in FIG. 4, the panels 10, 12 may be secured to a support 88, such as a tubular support, with a seal plate 90 positioned between the panels 10, 12 and the support 88. The joint insert 80 may be installed in a similar manner as described above with respect to joint insert 40.

Figure 5:
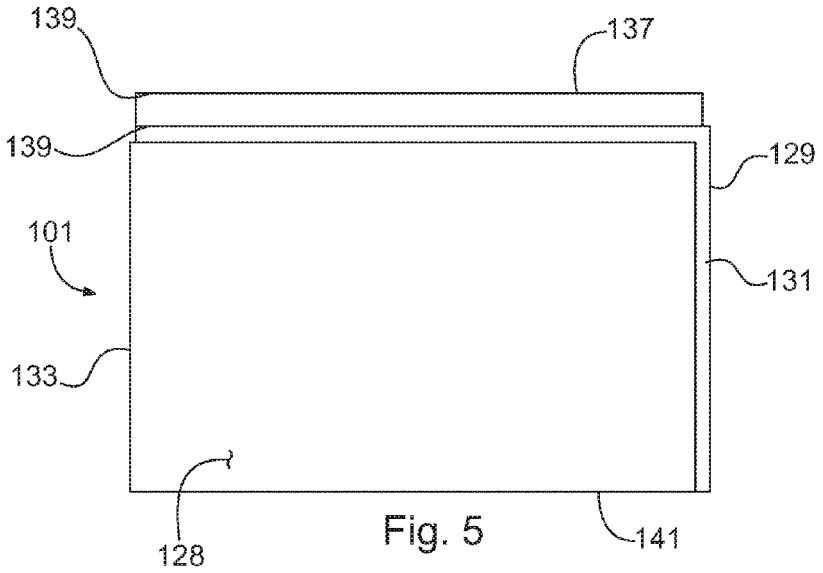
FIG. 5 is a front elevational view of a composite panel according to a fourth embodiment of the present invention.
Figure 6:
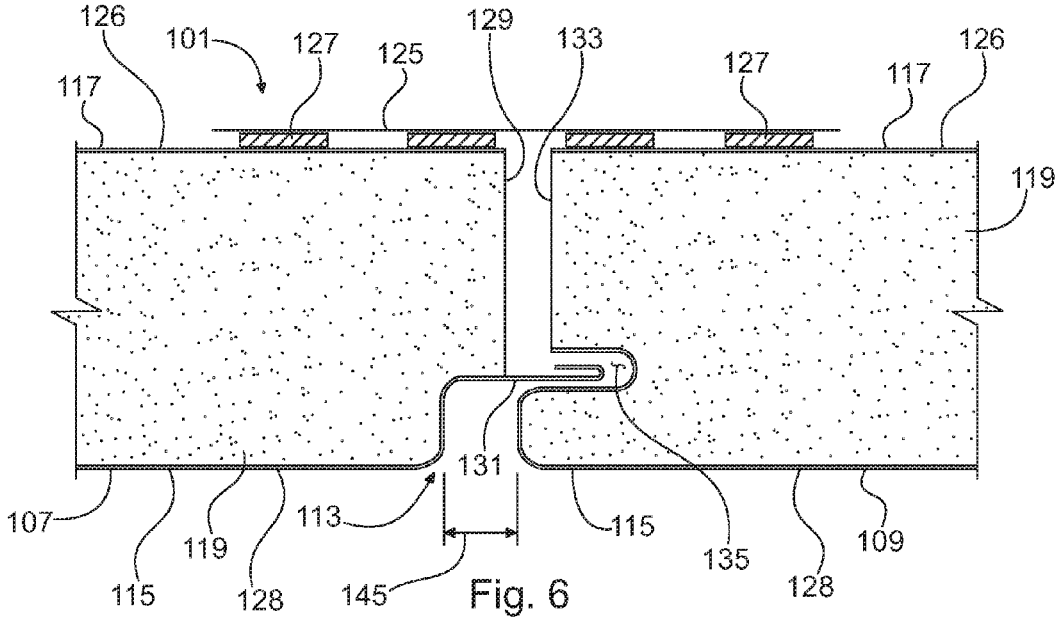
FIG. 6 is a partial cross-sectional view of the composite panel shown in FIG. 5, showing the panel adjacent to another composite panel.
Figure 7:
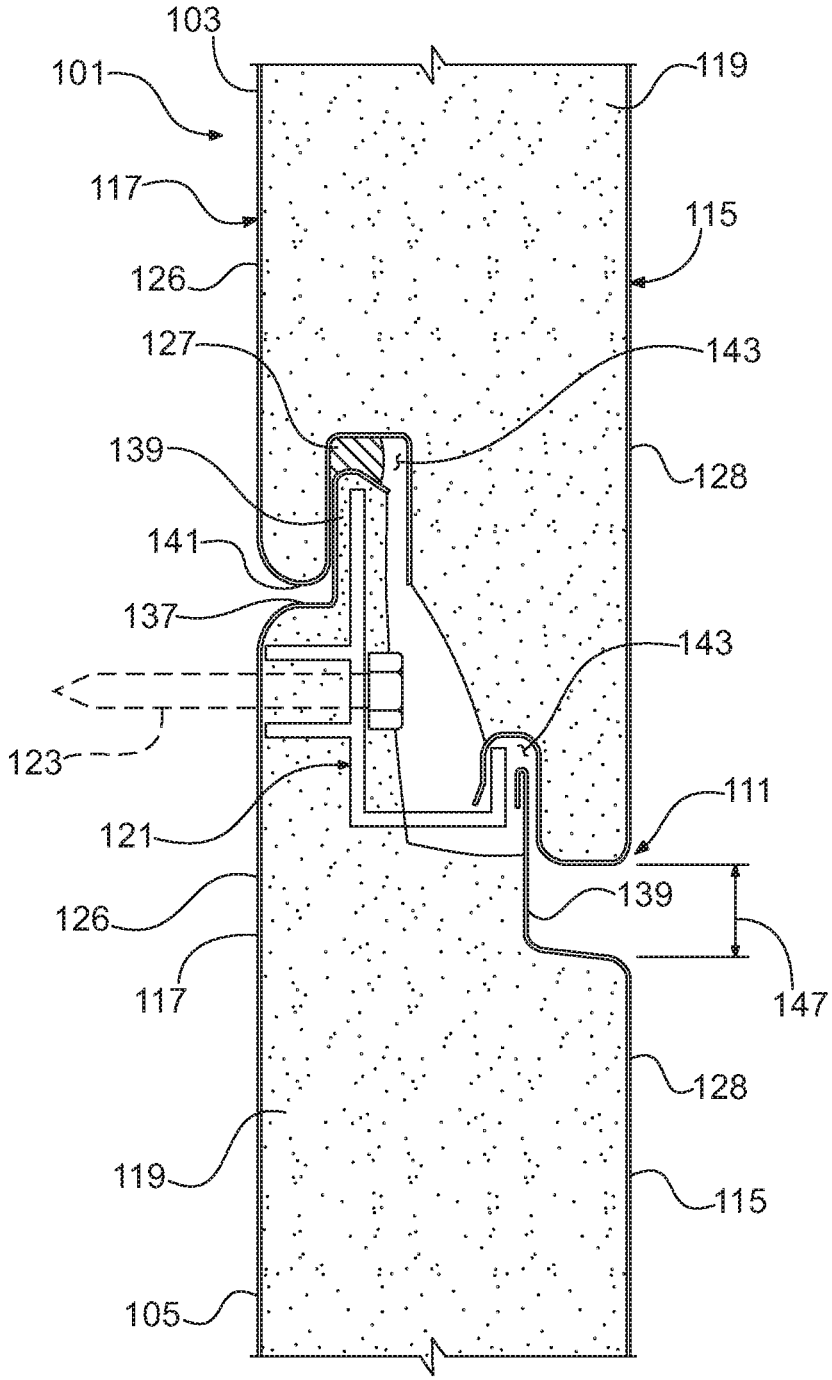
FIG. 7 is a partial cross-sectional view of the composite panel shown in FIG. 5, showing the panel adjacent to another composite panel.

Referring to FIGS. 5-7, a composite panel assembly 101 according to a fourth embodiment includes upper and lower building panels 103, 105 and left and right panels 107, 109. The upper and lower panels 103, 105 are positioned adjacent to each other to define a horizontal joint 111 (shown in FIG. 7). The left and right panels 107, 109 are positioned adjacent to each other to define a vertical joint 113. Each of the panels 103, 105, 107, 109 includes an outer face 115 and an inner liner 117 with a core 119 positioned therebetween. The outer face 115 and inner liner 117 may be metal and the core 119 may be an insulated foam material, although other suitable materials may be used for the outer face 115, inner liner 117, and core 119. Each of the panels 103, 105, 107, 109 also include a panel clip 121 and fastener 123 at the horizontal joint 111. A number of fasteners 123 and clips 121 secure the panels 103, 105, 107, 109 to a structural support (not shown), such as a stud. Flashing 125 is positioned between the inner liner 117 and the structural member with sealant 127, such as a non-curing butyl sealant, provided between the inner liner 117 and the flashing 125 to seal the panels 103, 105, 107, 109 at the vertical joint 113. The panels 103, 105, 107, 109 each include an inner surface 126 and an outer surface 128. As shown in FIG. 5, each panel 103, 105, 107, 109 includes a right edge 129, a left edge 133, a top edge 137, and a bottom edge 141. The panels 103, 105, 107, 109 may be installed in a similar manner as described above in connection with the panels 6, 8, 10, 12 shown in FIGS. 1 and 2.

Referring again to FIGS. 5-7, the right edge 129 of the panels 103, 105, 107, 109 includes an extension 131 and the left edge 133 of the panels 103, 105, 107, 109 includes a pocket 135 that is configured to receive the extension 131 from adjacent panels. The top edge 137 similarly includes a pair of extensions 139 and the bottom edge 141 of the panels 103, 105, 107, 109 includes a pair of pockets 143 that are configured to receive the extensions 139. More specifically, as shown in FIG. 6, the extension 131 of the left panel 107 is formed by a portion of the outer face 115 that extends beyond the core 119. The extension 131 is also spaced a distance away from the outer surface 128 of the panel 107. The left edge 133 of the right panel 109 includes a pocket 135 that is configured to receive the extension 131 from the adjacent left panel 107.

The pocket 135, which is generally U-shaped in cross-section, is formed by a portion of the outer face 115 of the right panel 109, although a portion of the core 119 may also form all or part of the pocket 135. The pocket 135 is also spaced away from the outer surface 128 of the panel 109 to receive the extension 131. When the left panel 107 and the right panel 109 are positioned adjacent to each other with the pocket 135 receiving the extension 131, a vertical reveal 145 is formed due to the spacing of the extension 131 away from the outer surface 128 of the panel 107. Such an arrangement also hides the extension 131 and the pocket 135 from view when the panels 107, 109 are installed. The extension 131 is slideable relative to the pocket 135 such that the width of the reveal 145 can be adjusted during installation of the panels 107, 109.

As shown in FIG. 7, one of the extensions 139 of the top edge 137 of the lower panel 105 is formed by a portion of the outer facer 115 that extend beyond the core 119 adjacent to the panel clip 121. The other of the pair of extension 139 of the top edge 137 of the lower panel 105 is formed by a portion of the inner liner 117 and the core 119 that surround an upper end of the panel clip 121. The extensions 139 are spaced apart in a direction that extends from the outer surface 128 to the inner surface 126 of the panel 105. Each of the extensions 139 are also located at a position intermediate the outer surface 128 and inner surface 126 of the panel 105. The pockets 143, which are generally U-shaped in cross-section, are formed by a portion of the outer face 115 and inner liner 117, respectively, of the upper panel 103, although a portion of the core 119 may also form all or part of the pockets 143. The pockets 143 are also spaced apart in a direction that extends from the outer surface 128 to the inner surface 126 of the panel 103. When the upper panel 103 and the lower panel 105 are positioned adjacent to each other with the pockets 143 receiving the extensions 139, a horizontal reveal 147 is formed due to the spacing of the outer extension 139 away from the outer surface 128 of the panel 105. This arrangement also hides the outer extension 139 and the pocket 143 from view when the panels 103, 105 are installed. Sealant 127 is positioned between the inner extension 139 and pocket 143. The extensions 139 are slideable relative to the pockets 143 such that the width of the reveal 147 can be adjusted during installation of the panels 103, 105.

Figure 8:
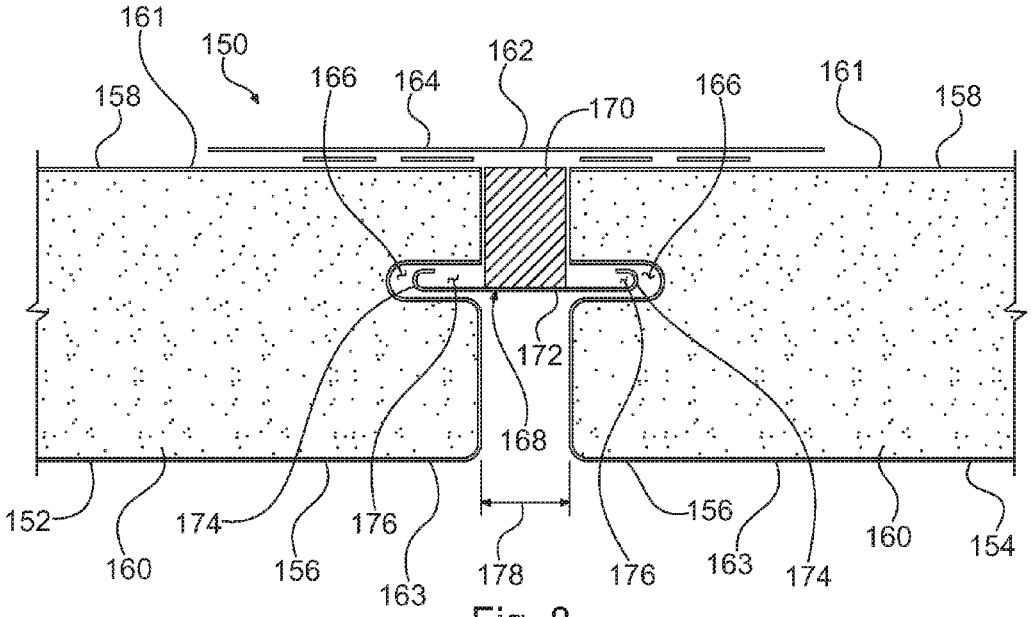
FIG. 8 is a partial cross-sectional view of a composite panel assembly according to a fifth embodiment of the present invention.

Referring to FIG. 8, a composite panel assembly 150 according to a fifth embodiment includes left and right panels 152, 154 with each panel having an outer face 156 and an inner liner 158 with a core 160 positioned therebetween. The outer face 156 and the inner liner 158 may be metal and the core 160 may be an insulated foam material, although other suitable materials may be used for the outer face 156, inner liner 158, and core 160. Flashing 162 is positioned between the inner liner 158 and a structural support (not shown), such as a stud, with sealant 164, such as a non-curing butyl sealant, provided between the inner liner 158 and the flashing 162. The panels 152, 154 each include an inner surface 161 and an outer surface 163. The panels 152, 154 may be installed in a similar manner as described above in connection with the panels 6, 8, 10, 12 shown in FIGS. 1 and 2.

Each of the panels 152, 154 include a recessed portion 166 located at a position intermediate the inner surface 161 and the outer surface 163 of the panels 152, 154. The recessed portions 166, which are generally U-shaped in cross-section, receive an insert 168 that is positioned between the panels 152, 154 at a location where the panels 152, 154 are joined. The insert 168 engages the outer face 156 or core 160 within the recessed portions 166. The recessed portions 166 are formed by a portion of the outer face 156 of each panel 152, 154, although the recessed portions 166 could be formed in whole in or part by the respective cores 160. The insert 168 includes a body 170 and a facer 172. The facer 172 of the insert 168 has curled edges 174 that are received by the recessed portions 166. The curled edges 174 of the facer 172 increase the stiffness of the facer, although other suitable stiffening arrangements may be utilized. The body 170 is provided between the panels 152, 154 and establishes a distance between the panels 152, 154. The body 170 may be foam and the facer 172 may be metal. The facer 172 may be painted or colored in some other manner to change the aesthetic appearance of the facer 172, which is visible after installation of the panels 152, 154. The curled edges 174 of the facer 172 also define a pair of cavities in each of the recessed portions 166. When installed, the panels 152, 154 form a vertical reveal 178, although a similar arrangement could be utilized in a horizontal joint and reveal. The width of the reveal 178 is adjustable over varying the width of the body 170 of the insert 168.

Figure 9:
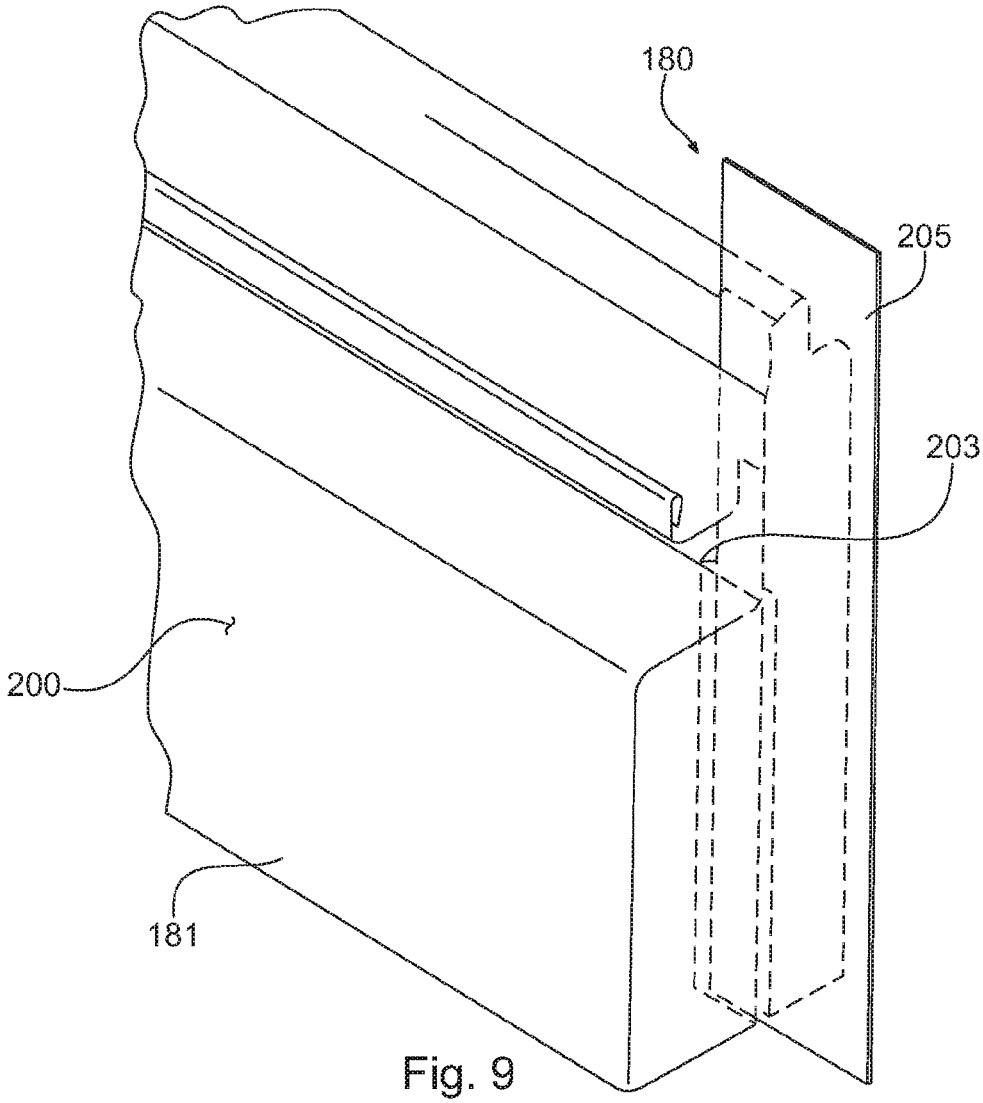
FIG. 9 is a partial perspective view of a composite panel assembly according to a sixth embodiment of the present invention.
Figure 10:
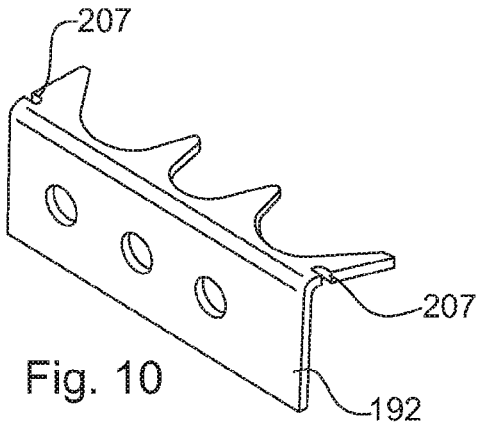
FIG. 10 is a perspective view of a clip utilized in the composite panel shown in FIG. 9.
Figure 11:
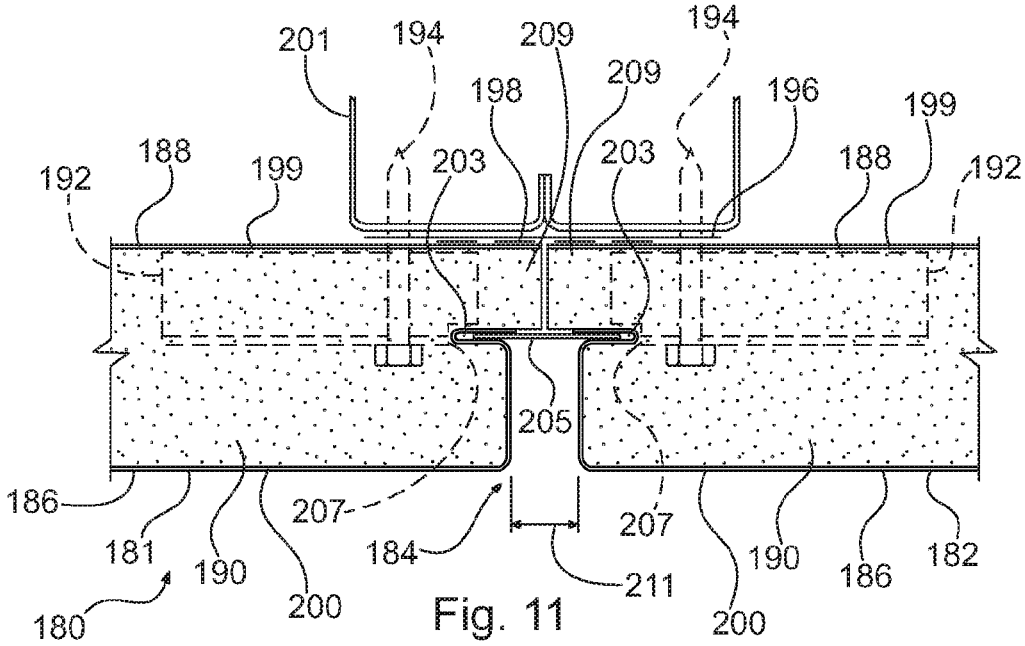
FIG. 11 is a partial cross-sectional view of the composite panel shown in FIG. 9, showing the panel.

Referring to FIGS. 9-11, a composite panel assembly 180 according to a sixth embodiment includes left and right panels 181, 182 that are positioned adjacent to each other to define a vertical joint 184. Each of the panels 181, 182 includes an outer face 186 and an inner liner 188 with a core 190 positioned therebetween. The outer face 186 and inner liner 188 may be metal and the core 190 may be an insulated foam material, although other suitable materials may be used for the outer face 186, inner liner 188, and core 190. Each of the panels 181, 182 also include a panel clip 192 and fasteners 194 adjacent the vertical joint 184. The panels 181, 182 are secured to a support 201, such as a stud, via the fasteners 194 and the clips 192. Flashing 196 is positioned between the inner liner 188 of each panel 181, 182 and the support 201 with sealant 198, such as non-curing butyl sealant, provided between the inner liner 188 and the flashing 196. The panels 181, 182 each include an inner surface 199 and an outer surface 200.

Similar to the composite panel assembly 150 shown in FIG. 8, each of the panels 181, 182 include a recessed portion 203 located at a position intermediate the inner surface 199 and the outer surface 200 of the panels 181, 182. The recessed portions 203, which are generally U-shaped in cross-section, receive an insert 205 that is positioned between the panels 181, 182 at the vertical joint 184. The insert 205 engages the outer face 186 or core 190 within the recessed portions 203. The recessed portions 203 may be formed by a portion of the outer face 186 of each panel 181, 182 or may be formed in whole in or part by the respective cores 190. As shown in FIG. 9, the insert 205 is an elongate metal body and generally plate-like, although other suitable shapes or materials may be utilized. For instance, the insert 205 may include ribs, curled edges, or any other suitable arrangement for increasing the stiffness of the insert 205. The insert 205 may be painted or colored in some other manner to change the aesthetic appearance of the insert 205, which is visible after installation of the panels 181, 182. As shown in FIGS. 10 and 11, the panel clips 192 each include a notch 207 for receiving and accommodating a portion of the recessed portions 203 and insert 205. The panel clips 192, however, may not include the notch 207 with the panel clips 192 merely being sufficiently spaced from the recessed portion 203 to avoid interference. In contrast to the insert 168 shown in FIG. 8 and discussed above, the insert 205 of the present embodiment does not establish a distance or space between the panels 181, 182. Rather, the panels 181, 182 include extending portions 209 to form a vertical reveal 211. In particular, the extending portions 209 create a stepped or staggered edge by extending a portion of the panel further toward the vertical joint 184 on one side (inner side) of the recessed portions 203 relative another portion of the panel on the other side (outer side) of the recessed portions 203. The extending portions 209 may be formed by a portion of the inner liner 188 and foam core 190. The size of the extending portions 209 may be modified to corresponding adjust the size of the vertical reveal 211.

Figure 12:
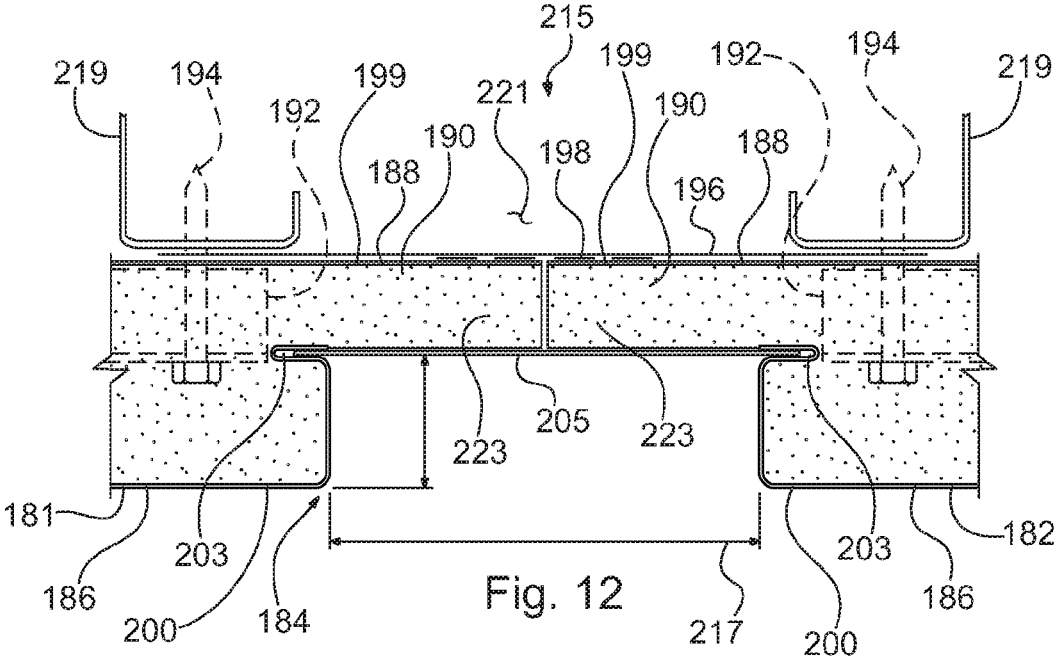
FIG. 12 is a partial cross-sectional view of a composite panel according to a seventh embodiment of the present invention.

Referring to FIG. 12, a composite panel assembly 215 according to a seventh embodiment is disclosed. The composite panel assembly 215 is similar to the composite panel assembly 180 discussed above and shown in FIGS. 9-11. Like reference numerals are used for like elements. The composite panel assembly 215 similarly forms a vertical reveal 217 between the panels 181, 182. The composite panel assembly 215, however, includes spaced apart supports 219, such as studs, that define a space 221 therebetween. The composite panel assembly 215 also includes extending portions 223 that are similar to the extending portions 209 described above, but are wider to correspondingly form a wider vertical reveal 217 relative to the reveal 211 of composite panel assembly 180 shown in FIG. 11.

While several embodiments were described in the foregoing detailed description, those skilled in the art may make modifications and alterations to these embodiments without departing from the scope and spirit of the invention. Accordingly, the foregoing description is intended to be illustrative rather than restrictive.

The invention claimed is:

1. A composite panel assembly comprising:

first and second panels, an edge of the first panel is configured to be positioned adjacent to an edge of the second panel to define a joint, with the edge of the first panel and the edge of the second panel each defining a recessed portion, the first and second panels each comprising an outer sheet and an inner sheet with a foam core positioned between the outer sheet and the inner sheet, a portion of the inner sheet and the foam core of each of the first and second panels is recessed relative to the remaining portion of the foam core and the outer sheet of each of the first and second panels to define the respective recessed portions of the first and second panels; and an insert configured to be positioned between the first and second panels at the joint when the first and second panels are positioned adjacent to each other, with a portion of the insert configured to be received within the respective recessed portions of the first and second panels, the insert comprising an insulating body.

2. The composite panel assembly of claim 1, wherein the first and second panels include a vertical reveal at the joint with the vertical reveal defined by the first and second panels and the insert.

3. The composite panel assembly of claim 1, wherein the insert comprises an insulating foam body.

4. The composite panel assembly of claim 1, wherein the first and second panels each include an inner surface and an outer surface with the recessed portions of the first panel and the second panel extending from the respective inner surfaces to a position intermediate the respective inner surfaces and the respective outer surfaces.

5. The composite panel assembly of claim 1, wherein the insert further comprises a facer secured to the insulating body.

6. A composite panel assembly comprising:

first and second panels with an edge of the first panel positioned adjacent to an edge of the second panel to define a joint, and with the edge of the first panel and the edge of the second panel each defining a recessed portion; and an insert positioned between the first and second panels at the joint, with a portion of the insert received within respective recessed portions of the first and second panels, wherein the insert comprises a body and a facer, and wherein the facer of the insert engages the first and second panels with the body having a pair of front chamfered portions to define drain cavities.

7. The composite panel assembly of claim 6, wherein the body has a pair of rear chamfered portions to define sealant receiving spaces.

8. The composite panel assembly of claim 1, wherein the first and second panels each include an extended portion at the joint to form a reveal.

9. The composite panel assembly of claim 6, wherein the body of the insert comprises insulating foam.

* * * * *